United States Patent [19]

Bercik

[11] Patent Number: 4,898,532

[45] Date of Patent: Feb. 6, 1990

[54] RETRACTABLE LIGHTER APPARATUS

[76] Inventor: David P. Bercik, 516 Elmira St., Monongahela, Pa. 15063

[21] Appl. No.: 355,324

[22] Filed: May 22, 1989

[51] Int. Cl.[4] ..... F23Q 2/32

[52] U.S. Cl. ..... 431/253; 431/343; 206/86; D3/100; D27/144

[58] Field of Search ..... 431/253, 343; 131/185; 206/85, 86–94; D3/100, 103, 105; D27/142, 143, 144

[56] References Cited

U.S. PATENT DOCUMENTS

| | | | |
|---|---|---|---|
| 2,958,416 | 11/1960 | Clark | 206/87 |
| 4,082,496 | 4/1978 | Johnson | 431/253 X |
| 4,363,432 | 12/1982 | Warthen | 206/87 X |
| 4,486,169 | 12/1984 | Lewis | 431/253 |
| 4,625,861 | 12/1986 | Krog | 206/86 X |

*Primary Examiner*—Randall L. Green

*Attorney, Agent, or Firm*—Leon Gilden

[57] ABSTRACT

A retractable lighter apparatus discloses a retractable housing member including a spring-biased retractable first length of chain positionable within a housing secured to a second length of chain with an intermediate abutment sphere to maintain the second length of chain exteriorly of the housing. The second length of chain is integrally secured to a "C" shaped spring clip at its remote end securable about a cigarette lighter. The cigarette lighter and clip are positionable within a pouch of an internal diameter complementary to that of the external diameter of the "C" shaped clip, wherein the "C" shaped clip and associated second length of chain are directed within the pouch and along a slot axially positioned through a wall of the pouch. The retraction member and the pouch are each provided with clips for securement to various garment portions of an individual.

9 Claims, 1 Drawing Sheet

RETRACTABLE LIGHTER APPARATUS

BACKGROUND OF THE INVENTION

1. Field of the Invention

The field of invention relates to lighter apparatus, and more particularly pertains to a new and improved retractable lighter apparatus wherein the same may be extended for use and thereafter retracted for securement within a pouch.

2. Description of the Prior Art

The use of lighter apparatus and its convenient storage upon an individual during periods of non-use, as well as use, has been explored by the prior art. The prior art has heretofore utilized various arrangements to secure a cigarette lighter with respect to an individual, however, the fragile nature of cigarette lighters and their being damaged upon impact is known in the prior art. The instant invention attempts to overcome deficiencies of the prior art by providing a means to store a cigarette lighter during periods of non-use and readily enable access to the lighter when desired while preventing accidental dropping of the lighter during use. Examples of prior art devices involving cigarette lighters may be found in Design patents 114,210; 152,386; 186,052; 163,563; and 267,597 illustrating various technics for storage of a cigarette lighter, but failing to set forth the teaching of the instant invention.

As such, it may be appreciated that there is a continuing need for a new and improved retractable lighter apparatus wherein the same addresses both the problems of effectiveness in construction and ease of use, and in this respect, the present invention substantially fulfills this need.

SUMMARY OF THE INVENTION

In view of the foregoing disadvantages inherent in the known types of lighter apparatus now present in the prior art, the present invention provides a retractable lighter apparatus wherein the same enables secure storage of a cigarette lighter during periods of non-use and further enables immediate and convenient access to the lighter when desired. As such, the general purpose of the present invention, which will be described subsequently in greater detail, is to provide a new and improved retractable lighter apparatus which has all the advantages of the prior art cigarette lighter storage devices and none of the disadvantages.

To attain this, the retractable lighter apparatus essentially comprises a spring-biased retractable member housing a first length of chain separated from a second length of chain by an abutment sphere to maintain a predetermined length of chain exteriorly of the retraction member. The retraction member is secured to a garment of clothing, such as a belt, by use of a spring biased clip wherein a remote end of the second length of chain or tether line is fixedly secured to a spring-biased "C" shaped clip of a predetermined external diameter. The "C" shaped clip is slidably positionable within a pouch defining a cylindrical interior of substantially the same diameter as defined by the "C" shaped clip. The second length of chain and "C" shaped clip are slidably mounted within the housing along a slot axially positioned parallel to the axis of the pouch and wherein the pouch is securable to a further portion of a garment of clothing by a first flexible securement strap securable to an underlying rigid strap utilizing coacting hook and loop fastener patches.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retractable lighter apparatus which has all the advantages of the prior art lighter securement arrangements and none of the disadvantages.

It is another object of the present invention to provide a new and improved retractable lighter apparatus which may be easily and efficiently manufactured and marketed.

It is a further object of the present invention to provide a new and improved retractable lighter apparatus which is of a durable and reliable construction.

An even further object of the present invention is to provide a new and improved retractable lighter apparatus which is susceptible of a low cost of manufacture with regard to both materials and labor, and which accordingly is then susceptible of low prices of sale to the consuming public, thereby making such retractable lighter apparatus economically available to the buying public.

Still yet another object of the present invention is to provide a new and improved retractable lighter apparatus which provides in the apparatuses and methods of the prior art some of the advantages thereof, while simultaneously overcoming some of the disadvantages normally associated therewith.

Still another object of the present invention is to provide a new and improved retractable lighter apparatus wherein the same enables storage within a pouch of a cigarette lighter during periods of non-use and enables extension of a retractable tether line to enable access of the cigarette lighter to a cigarette or the like to be ignited.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
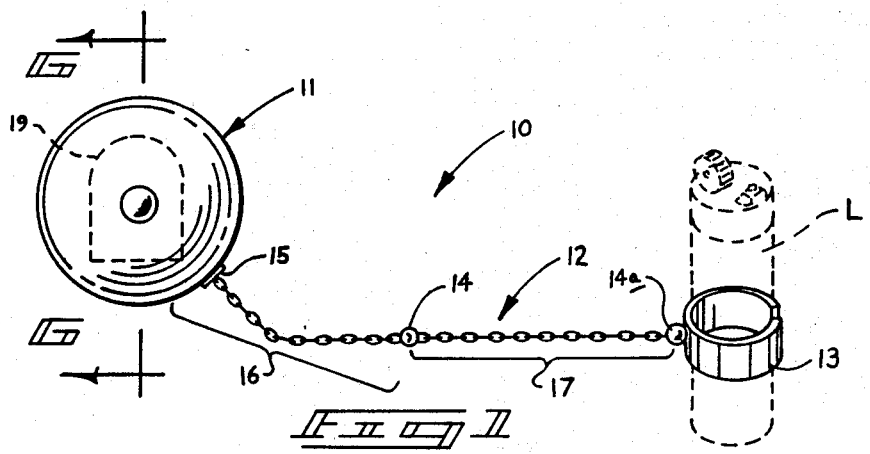
FIG. 1 is an isometric illustration of the instant invention prior to insertion within an associated pouch.
Figure 5:
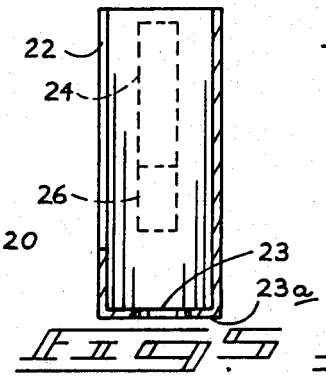
FIG. 5 is an orthographic view taken along the lines 5—5 of FIG. 2 in the direction indicated by the arrows.
Figure 2:
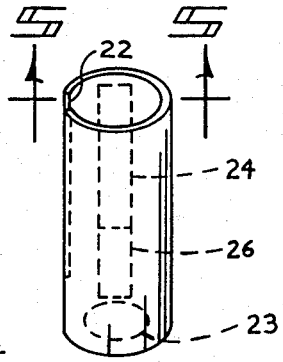
FIG. 2 is an isometric illustration of the pouch of the instant invention.
Figure 4:
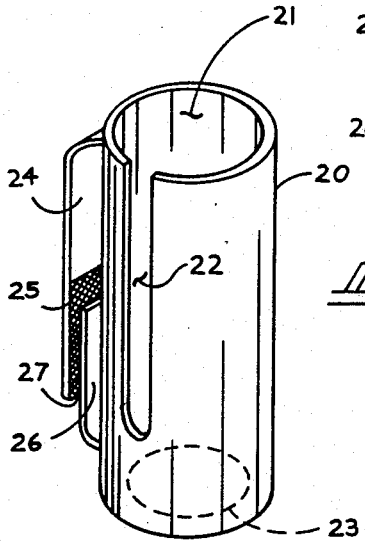
FIG. 4 is a further isometric illustration of the pouch of the instant invention.
Figure 3:
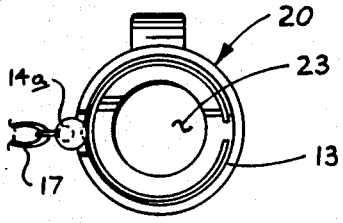
FIG. 3 is a top orthographic view of the pouch with the "C" clip inserted therein.

With reference now to the drawings, and in particular to FIGS. 1 to 6 thereof, a new and improved retractable lighter apparatus embodying the principles and concepts of the present invention and generally designated by the reference numeral 10 will be described.

More specifically, the retractable lighter apparatus 10 essentially comprises a cylindrical retraction member 11 to bias a first length of tether line 16 of chain 12 within the housing. The tether chain 12 comprises the first length of tether chain 16 and a second length of tether chain 17 separated by a first abutment sphere 14. The abutment sphere 14 is of a diameter greater than that of the entrance opening 15 of the retraction member 11 to prevent retraction of the second length of tether chain 17 interiorly of the housing. It should be further noted that the first length of tether chain 16 is of a length greater than that of the second length of tether chain 17, whereas the first length of tether chain 16 enables the entire tether chain 12 to be extended to enable access of an associated cigarette lighter "L" to a cigarette or other combustible objects to be ignited, whereas the positioning of the second length of tether chain 17 exteriorly of the housing is to enable positioning of an associated lighter pouch 20 about a predetermined portion of an individual, such as along the belt worn by an individual or within a pocket, etc.

The second length of tether chain 17 is provided with a remote end terminating in a second abutment sphere **14*a* that is integrally secured to a spring-biased "C" clip 13. The spring-biased "C" clip 13** enables an encircling securement of an associated cigarette lighter "L" therein.

Figure 6:
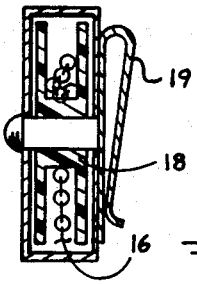
FIG. 6 is an orthographic cross-sectional view of the retraction member of the instant invention.

As illustrated in FIG. 6, the retraction member 11 is provided with an internal retraction spring 18 secured to the first length of tether chain 16 to withdraw the tether chain interiorly of the housing and is further formed with a spring-biased housing clip 19 integrally secured and generally parallel to a rear surface of the housing 11 and integrally secured thereto.

The cylindrical lighter pouch 20 is formed with a cylindrical interior 21 defining a predetermined interior diameter that is substantially equal to the predetermined exterior diameter of the spring-biased "C" clip 13 to enable a complementary sliding reception of the "C" clip and associated lighter "L" within the cylindrical interior 21. An elongate slot 22 of a length less than that of the wall of the cylindrical lighter pouch 20 is formed through the exterior wall and is generally parallel to an axis defined by the lighter pouch 20. A cylindrical opening 23 is formed within and orthogonally through a floor of the cylindrical lighter pouch 20 and is of a further diameter less than that of the predetermined of the "C" clip 13 and of the cylindrical interior 21. The cylindrical opening 23 enables an individual to direct pressure against the bottom surface of the lighter "L" positioned within the housing "L" to enhance extraction of the lighter from interiorly of the lighter pouch 20. The second abutment sphere **14*a* integrally secured to the "C" shaped clip 13 is of a cross-sectional dimension greater than that of the associated chain 12 wherein the diameter of the second abutment sphere 14*a* is substantially equal to that of the width of the slot 22 to guide the "C" shaped clip within the slot 22 and within the cylindrical interior 21 of the pouch 20**.

The lighter pouch 20 is secured to a portion of outer wear of an individual utilizing a first flexible securement strap 24 integrally secured to an upper portion of the cylindrical lighter pouch 20 and includes a first hook and loop fastener patch 25 upon an interior surface thereon selectively cooperative with a second hook and loop fastener patch 27 formed to an exterior surface of a second rigid securement strap 26 integrally secured to a lowermost portion of the pouch 20 on a cylindrical exterior wall thereof. The second rigid securement strap 26 is configured in alignment with the first securement strap 24 to encompass a portion of a belt or the like within the overlying relationship of the first securement 24 over the second rigid securement strap 26. In this manner, the respective first and second hook and loop fastener patches 25 and 26 may further secure a fabric garment therebetween for securement of the pouch upon a portion of fabric clothing.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A retractable lighter apparatus comprising, in combination, a retraction member including a first tether line secured interiorly of the retraction member and biased interiorly of the retraction member in a first position and extensible exteriorly of the retraction member to a second extended position, and a second tether line secured to said first tether line and including an abutment means for maintaining said second tether line exteriorly of said housing in said first and second positions, and a clip member integrally secured to a terminal free end of said second tether line to clampingly secure a lighter assembly therewithin, and a pouch means for securement of said clip means and said lighter assembly in said first position.

2. A retractable lighter apparatus as set forth in claim 1 wherein said retraction member includes a cylindrical housing with a resilient clip integrally secured to a rear surface of the housing.

3. A retractable lighter apparatus as set forth in claim 2 wherein the abutment means includes a first spherical abutment member integrally joining the first and second tether lines together.

4. A retractable lighter apparatus as set forth in claim 3 wherein the cylindrical housing includes an entrance opening for slidingly receiving the first tether line therethrough, and wherein the first spherical member defines a cross-sectional configuration greater than that of the entrance opening to prevent withdrawal of the first spherical member interiorly of the housing.

5. A retractable lighter apparatus as set forth in claim 4 wherein the clip member is defined by a resiliently biased "C" shaped clip to encircle the lighter assembly and wherein the "C" shaped clip is of a predetermined diameter.

6. A retractable lighter apparatus as set forth in claim 5 wherein the pouch member includes an elongate cylindrical pouch with an interior diameter equal to the predetermined diameter.

7. A retractable lighter apparatus as set forth in claim 6 wherein the cylindrical pouch further includes an elongate slot of a length greater than that defined by a length of the cylindrical pouch, and wherein the slot is of a predetermined width, and wherein a second spherical member is integrally secured to the "C" shaped clip and wherein the second spherical member is equal to the predetermined width.

8. A retractable lighter apparatus as set forth in claim 7 wherein the cylindrical pouch includes a floor including an orthogonally directed opening axially aligned with the cylindrical housing and of a further diameter less than the predetermined diameter.

9. A retractable lighter apparatus as set forth in claim 8 wherein the cylindrical pouch further includes a first flexible strap integrally secured to an exterior surface of the cylindrical pouch adjacent an upper edge of the cylindrical pouch, and wherein the first securement strap is flexible and includes a first hook and loop fastener patch formed to an interior surface thereof, and further including a second rigid securement strap integrally to an exterior surface of the cylindrical housing aligned with the first securement strap and integrally secured to the cylindrical pouch adjacent a lowermost edge thereof, and wherein the second securement strap includes a second hook and loop fastener patch formed to an exterior surface thereof for cooperative securement with the first hook and loop fastener strap.

* * * * *